US010612409B2

(12) United States Patent
Griffin et al.

(10) Patent No.: US 10,612,409 B2
(45) Date of Patent: Apr. 7, 2020

(54) ACTIVE CLEARANCE CONTROL COLLECTOR TO MANIFOLD INSERT

(71) Applicant: United Technologies Corporation, Farmington, CT (US)

(72) Inventors: David R. Griffin, Tolland, CT (US); Joseph E. Barker, Manchester, CT (US); James P. Chrisikos, Vernon, CT (US); Graham R. Philbrick, Durham, CT (US)

(73) Assignee: United Technologies Corporation, Farmington, CT (US)

( * ) Notice: Subject to any disclaimer, the term of this patent is extended or adjusted under 35 U.S.C. 154(b) by 869 days.

(21) Appl. No.: 15/239,899

(22) Filed: Aug. 18, 2016

(65) Prior Publication Data

US 2018/0051583 A1 Feb. 22, 2018

(51) Int. Cl.

| | |
|---|---|
| ***F01D 11/24*** | (2006.01) |
| ***F01D 11/00*** | (2006.01) |
| ***F01D 25/24*** | (2006.01) |

(52) U.S. Cl.

CPC ..... *F01D 11/24* (2013.01); *F01D 11/005* (2013.01); *F01D 25/24* (2013.01); *F05D 2220/32* (2013.01); *F05D 2260/20* (2013.01)

(58) Field of Classification Search

None

See application file for complete search history.

(56) References Cited

U.S. PATENT DOCUMENTS

| | | | | |
|---|---|---|---|---|
| 4,131,388 | A | 12/1978 | Brodell | |
| 4,815,272 | A | 3/1989 | Laurello | |
| 5,205,115 | A * | 4/1993 | Plemmons | F01D 11/24 415/115 |
| 5,281,085 | A | 1/1994 | Lenahan | |
| 5,601,402 | A | 2/1997 | Wakeman | |
| 5,641,267 | A | 6/1997 | Proctor | |
| 5,791,872 | A | 8/1998 | Owen | |
| 6,126,389 | A | 10/2000 | Burdgick | |
| 6,149,074 | A | 11/2000 | Friedel et al. | |
| 6,350,102 | B1 | 2/2002 | Bailey | |
| 6,877,952 | B2 | 4/2005 | Wilson | |
| 7,114,914 | B2 * | 10/2006 | Gendraud | F01D 11/24 415/108 |

(Continued)

OTHER PUBLICATIONS

Scott B. Lattime, "Turbine Engine Clearance Control Systems: Current Practices and Future Directions", NASA/TM-2002-211794, AIAA-2002-3790, Sep. 2002.

(Continued)

*Primary Examiner* — Kayla M McCaffrey
(74) *Attorney, Agent, or Firm* — Getz Balich LLC

(57) ABSTRACT

Aspects of the disclosure are directed to an active clearance control system for an engine of an aircraft, comprising: a collector that is configured to receive a cooling fluid, at least two manifolds coupled to the collector, where a first of the manifolds is configured to receive at least a first portion of the cooling fluid from the collector and a second of the manifolds is configured to receive at least a second portion of the cooling fluid from the collector, and an insert coupled to the collector and the manifolds, where the insert is configured to seal an interface between the collector and the at least two manifolds over an operating range of the engine.

10 Claims, 5 Drawing Sheets

(56) References Cited

U.S. PATENT DOCUMENTS

| | | | |
|---|---|---|---|
| 7,819,626 | B2 | 10/2010 | Lee |
| 8,152,446 | B2 | 4/2012 | Zhang |
| 8,434,997 | B2 | 5/2013 | Pinero |
| 8,720,317 | B2 | 5/2014 | Lawler |
| 9,039,346 | B2 | 5/2015 | Muralidharan |
| 2004/0018084 | A1 | 1/2004 | Halliwell |
| 2014/0109596 | A1 | 4/2014 | Daguenet |
| 2016/0047269 | A1 | 2/2016 | Zacchera |

OTHER PUBLICATIONS

EP search report for EP17186230.3 dated Jan. 22, 2018.

* cited by examiner

ACTIVE CLEARANCE CONTROL COLLECTOR TO MANIFOLD INSERT

BACKGROUND

Gas turbine engines, such as those which power aircraft and industrial equipment, employ a compressor to compress air that is drawn into the engine and a turbine to capture energy associated with the combustion of a fuel-air mixture.

One or more cases are used to house the engine sections. For example, an engine case may house the turbine section. From the perspective of engine performance/efficiency, it is desirable to maintain as small a gap/clearance between the static engine case (stator) and the rotating turbine (rotor) blades as possible in order to maximize the energy that is captured by the turbine section as described above. However, a minimum clearance threshold must be maintained; otherwise, the turbine blades and the engine case (or an associated blade outer air seal) may rub against one another so as to reduce the usable lifetime of these components.

Active clearance control (ACC) hardware is used to control the temperature of the engine case. For example, supplying cool air to the engine case causes the engine case to contract, thereby decreasing the clearance between the engine case and the turbine blades. Referring to FIG. 2, an example of an ACC system 200 in accordance with the prior art is shown. In the system 200, bleed air 204 is taken from, e.g., the compressor and is supplied to one or more manifolds (e.g., manifolds 212*a* and 212*b*) via an inlet pipe 216 and a collector 218. The manifolds 212*a* and 212*b* are located proximate to, e.g., radially outboard of, a high pressure turbine engine case (not shown) and may dispense at least some of the bleed air 204 onto the case. A portion of the bleed air 204 may be conveyed to other portions/sections of the engine via piping/tubing 224.

The interface 232 between the collector 218 and the manifolds 212*a* and 212*b* may be susceptible to leaking. A leak may be caused by a movement/deflection of the collector 218 relative to the manifolds 212*a* and 212*b*. Such movement/deflection may be based at least in part on loads (e.g., thermal loads, vibratory loads, etc.) experienced by the engine hardware during engine operation. If a leak were to develop, the ACC system 200 may suffer a supply pressure drop that may result in a loss of closure of the ACC system 200.

BRIEF SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to an active clearance control system for an engine of an aircraft, comprising: a collector that is configured to receive a cooling fluid, at least two manifolds coupled to the collector, where a first of the manifolds is configured to receive at least a first portion of the cooling fluid from the collector and a second of the manifolds is configured to receive at least a second portion of the cooling fluid from the collector, and an insert coupled to the collector and the manifolds, where the insert is configured to seal an interface between the collector and the at least two manifolds over an operating range of the engine.

In some embodiments, the insert includes a first post that is seated in a first receptacle formed in the first manifold allowing the first portion of the cooling fluid to flow from the collector to the first manifold and a second post that is seated in a second receptacle formed in the second manifold allowing the second portion of the cooling fluid to flow from the collector to the second manifold. In some embodiments, the insert includes a third post that is seated in a third receptacle formed in the first manifold and a fourth post that is seated in a fourth receptacle formed in the second manifold. In some embodiments, the first post and the third post are substantially located in a first axial plane of the engine. In some embodiments, the second post and the fourth post are substantially located in a second axial plane of the engine, where the second axial plane is different from the first axial plane. In some embodiments, the insert includes a flange that is coupled to the first post and the second post and bridges a gap formed between the first manifold and the second manifold. In some embodiments, the flange includes at least one of a foam material, rubber, ceramic fibers, or graphite. In some embodiments, the first post has a square cross-section where the first post meets the first receptacle. In some embodiments, a radially-oriented height of the first post is larger than a threshold that is based on a maximum separation between the collector and the first manifold over the operating range of the engine. In some embodiments, the insert includes sheet metal. In some embodiments, the cooling fluid includes air received by the collector from a compressor section of the engine. In some embodiments, the system further comprises an inlet pipe configured to convey the air from the compressor section to the collector.

Aspects of the disclosure are directed to an insert configured to be coupled to a collector of an active clearance control system of an engine of an aircraft, the insert comprising: a flange, a first post coupled to the flange and configured to be seated in a first receptacle formed in a first manifold where the first post allows a first portion of bleed air in a collector to flow from the collector to the first manifold, a second post coupled to the flange and configured to be seated in a second receptacle formed in the first manifold where the second post allows a second portion of the bleed air in the collector to flow from the collector to the first manifold, a third post coupled to the flange and configured to be seated in a third receptacle formed in a second manifold where the third post allows a third portion of the bleed air in the collector to flow from the collector to the second manifold, and a fourth post coupled to the flange and configured to be seated in a fourth receptacle formed in the second manifold where the fourth post allows a fourth portion of the bleed air in the collector to flow from the collector to the second manifold. In some embodiments, the insert includes sheet metal and the flange includes a foam material.

BRIEF DESCRIPTION OF THE DRAWINGS

The present disclosure is illustrated by way of example and not limited in the accompanying figures in which like reference numerals indicate similar elements. The drawings are not necessarily drawn to scale unless specifically indicated otherwise.

DETAILED DESCRIPTION

Figure 1:
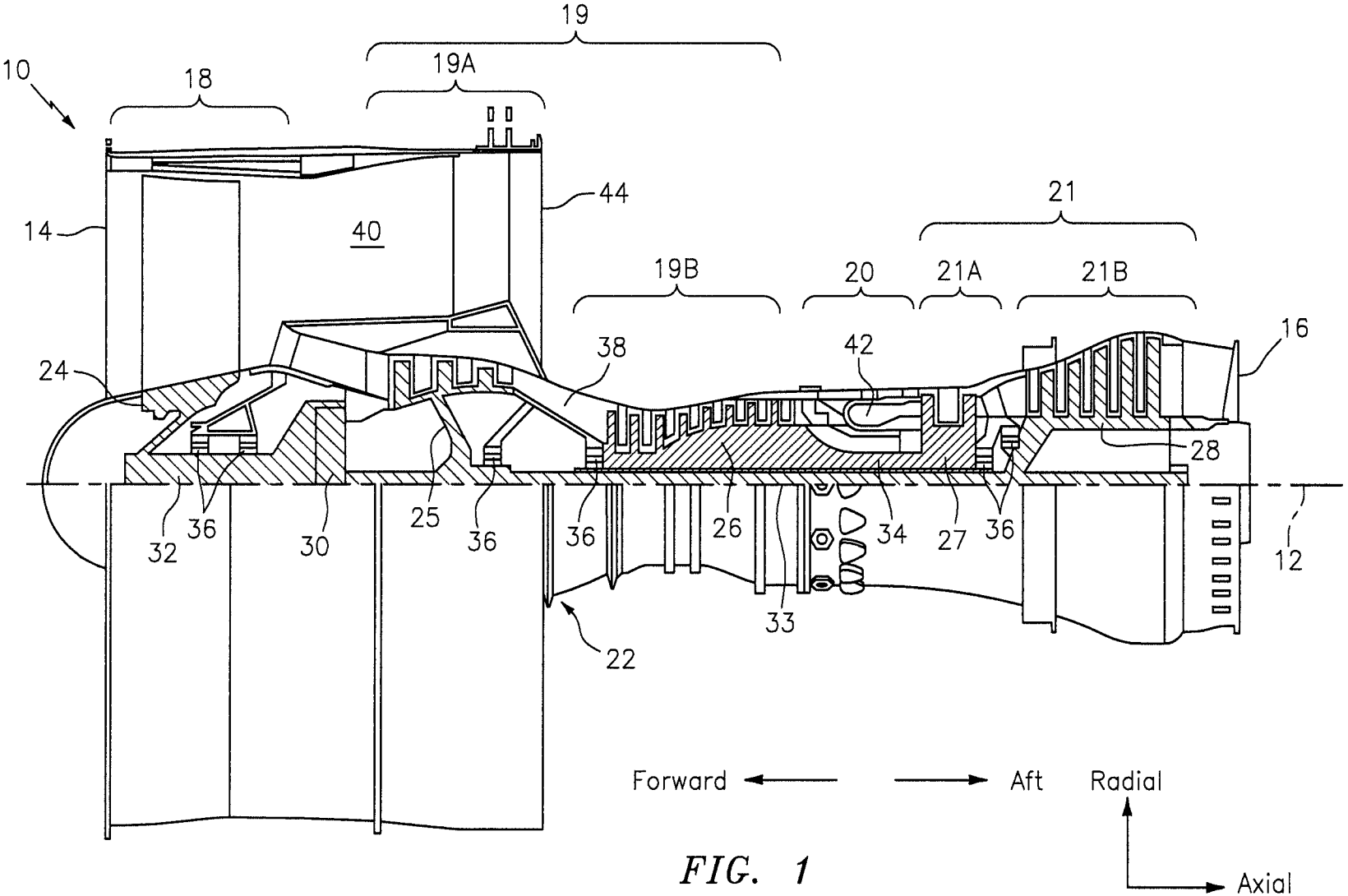
FIG. 1 is a side cutaway illustration of a geared turbine engine.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

In accordance with aspects of the disclosure, apparatuses, systems, and methods are directed to an insert. The insert may include a flange/gasket coupled to one or more posts/chimneys. A post may be seated within a receptacle formed in a manifold. The insert may seal a leak that might otherwise be present between a collector and the manifold, which may assist in the performance (e.g., closure) of an active clearance control (ACC) system.

Aspects of the disclosure may be applied in connection with a gas turbine engine. FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. Each of the engine sections 18-19B, 21A and 21B includes a respective rotor 24-28. Each of these rotors 24-28 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 24 is connected to a gear train 30, for example, through a fan shaft 32. The gear train 30 and the LPC rotor 25 are connected to and driven by the LPT rotor 28 through a low speed shaft 33. The HPC rotor 26 is connected to and driven by the HPT rotor 27 through a high speed shaft 34. The shafts 32-34 are rotatably supported by a plurality of bearings 36; e.g., rolling element and/or thrust bearings. Each of these bearings 36 is connected to the engine housing 22 by at least one stationary structure such as, for example, an annular support strut.

During operation, air enters the turbine engine 10 through the airflow inlet 14, and is directed through the fan section 18 and into a core gas path 38 and a bypass gas path 40. The air within the core gas path 38 may be referred to as "core air". The air within the bypass gas path 40 may be referred to as "bypass air". The core air is directed through the engine sections 19-21, and exits the turbine engine 10 through the airflow exhaust 16 to provide forward engine thrust. Within the combustor section 20, fuel is injected into a combustion chamber 42 and mixed with compressed core air. This fuel-core air mixture is ignited to power the turbine engine 10. The bypass air is directed through the bypass gas path 40 and out of the turbine engine 10 through a bypass nozzle 44 to provide additional forward engine thrust. This additional forward engine thrust may account for a majority (e.g., more than 70 percent) of total engine thrust. Alternatively, at least some of the bypass air may be directed out of the turbine engine 10 through a thrust reverser to provide reverse engine thrust.

FIG. 1 represents one possible configuration for an engine 10. Aspects of the disclosure may be applied in connection with other environments, including additional configurations for gas turbine engines. Aspects of the disclosure may be applied in connection with non-geared engines.

Figure 3:
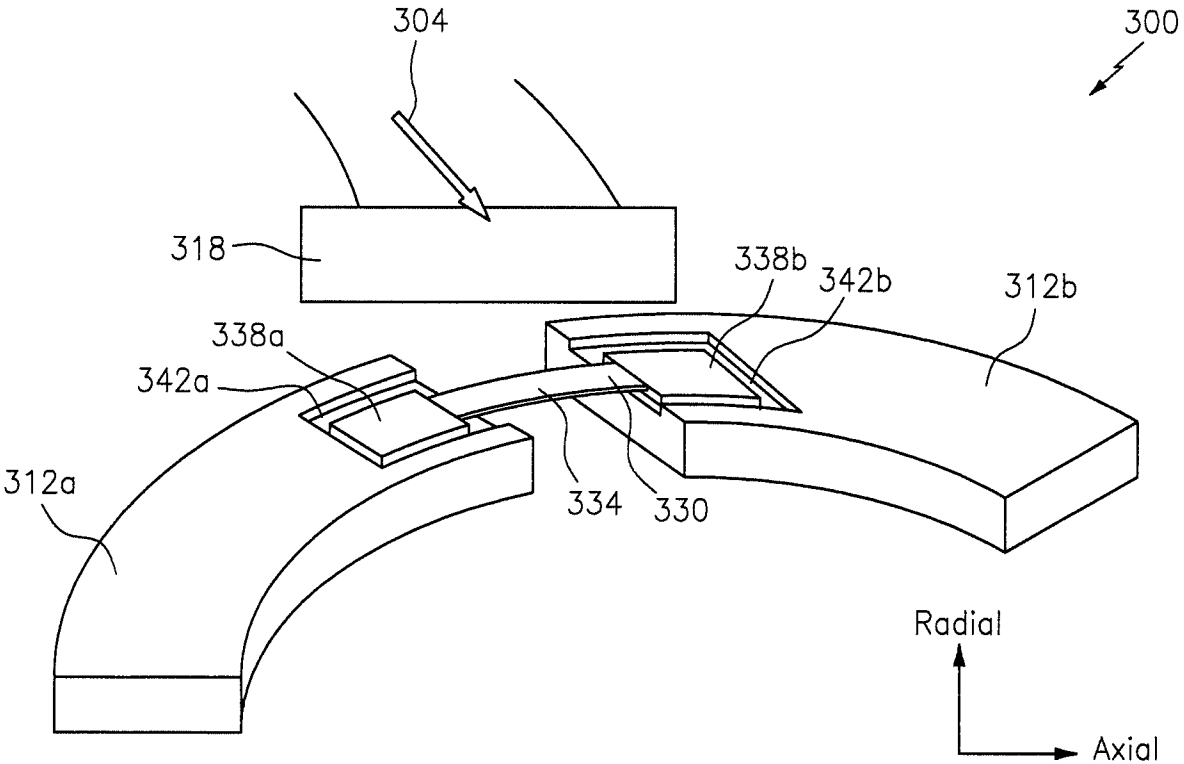
FIG. 3 illustrates a portion of an ACC system incorporating an insert in accordance with aspects of this disclosure.

Referring to FIG. 3, a (portion of an) ACC system 300 is shown. The system 300 may be incorporated at part of an engine, such as for example the engine 10 of FIG. 1.

The system 300 may include a collector 318 and manifolds 312*a* and 312*b*. The manifolds 312*a* and 312*b* and the collector 318 may be made of one or more materials, such as for example stainless steel. The collector 318 may be configured to receive a cooling fluid 304. The cooling fluid 304 may include air received from one or more sections of an engine (e.g., compressor section 19 of FIG. 1).

Depending on loading, one or more of the first manifold 312*a*, the second manifold 312*b*, and the collector 318 may move/deflect relative to at least one of the others of the first manifold 312*a*, the second manifold 312*b*, and the collector 318.

To mitigate/prevent the impact of a bleed air leak that might otherwise develop due to the movement/deflection described above, the system 300 may include an insert 330 located at the interface between the collector 318, the manifold 312*a*, and the manifold 312*b*. The insert 330 may be made of one or more materials. For example, the insert 330 may include sheet metal.

The insert 330 may include a flange/gasket 334 that may terminate at a first end in a first post/chimney 338*a* and at a second end in a second post/chimney 338*b*. The first and second posts 338*a* and 338*b* may allow bleed air to pass between the collector 318 and the respective manifold 312*a* and 312*b*. The flange 334 may include one or more materials, such as for example a foam material, rubber, ceramic fiber(s), graphite, etc., that has a large compression capability (e.g., larger than a threshold) to accommodate the movement/deflection described above.

The post 338*a* may be seated in a receptacle 342*a* formed in the manifold 312*a*. The post 338*b* may be seated in a receptacle 342*b* formed in the manifold 312*b*.

Figure 4:
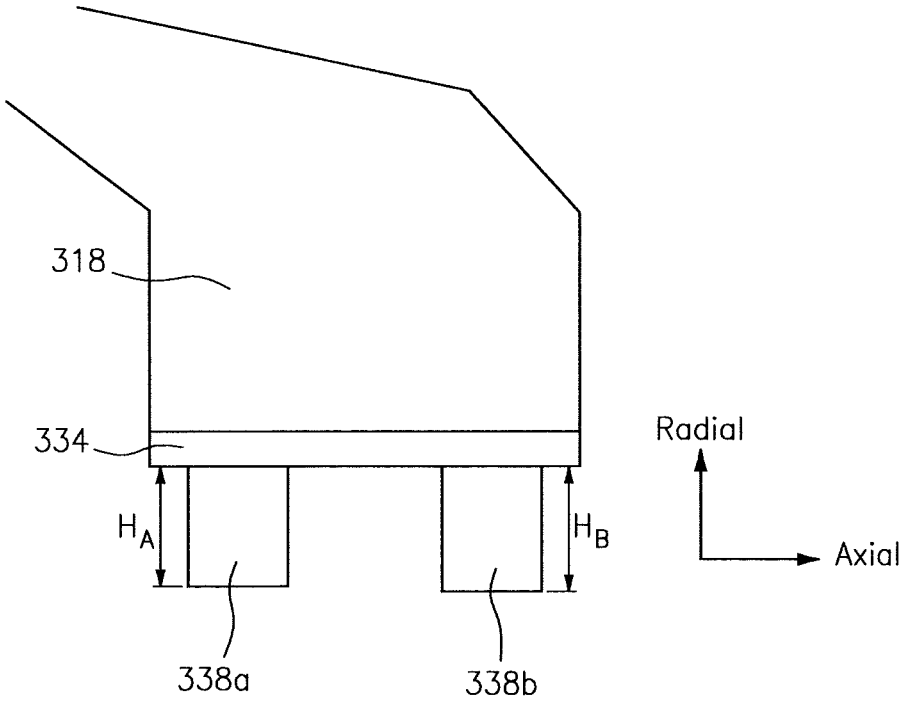
FIG. 4 illustrates a side perspective view of a portion of the ACC system of FIG. 3.

One or more dimensions of the posts 338*a* and 338*b* may be based on the loads that the system 300 may experience (which, in turn, may correspond to the amount/degree of movement/deflection that may be experienced over the engine operating range). Referring to FIGS. 3-4, a (radially-oriented) height $H_A$ of the post 338*a* may be selected so as to accommodate a (radially-oriented) movement/deflection of the collector 318 relative to the manifold 312*a* over the full engine operating range. The height $H_A$ may be selected to be at least long enough so as to ensure that the post 338*a* is seated in the receptacle 342*a* when the collector 318 experiences maximum (radial) separation from the manifold 312*a*. Similarly, the height $H_B$ may be selected to be at least long enough so as to ensure that the post 338*b* is seated in the receptacle 342*b* when the collector 318 experiences maximum (radial) separation from the manifold 312*b*.

While the example described above related to the (radially-oriented) heights $H_A$ and $H_B$ of the posts 338*a* and 338*b*, respectively, one skilled in the art would appreciate that other dimensions (e.g., an axial length or a circumferential width relative to an engine longitudinal centerline) of the posts 338*a* and 338*b* (or analogously, the receptacles 342*a* and 342*b*) may be selected to accommodate a range of other movements/deflections experienced by the engine hardware.

While the posts 338*a* and 338*b* and the receptacles 342*a* and 342*b* are shown as including a square profile/surface/cross-section where the posts meet the receptacles, other shapes may be used. For example, the posts 338*a*/338*b* and the receptacles 342*a*/342 may assume the shape of a rectangle, oval, circle, triangle, etc., and even irregular shapes.

Figure 2:
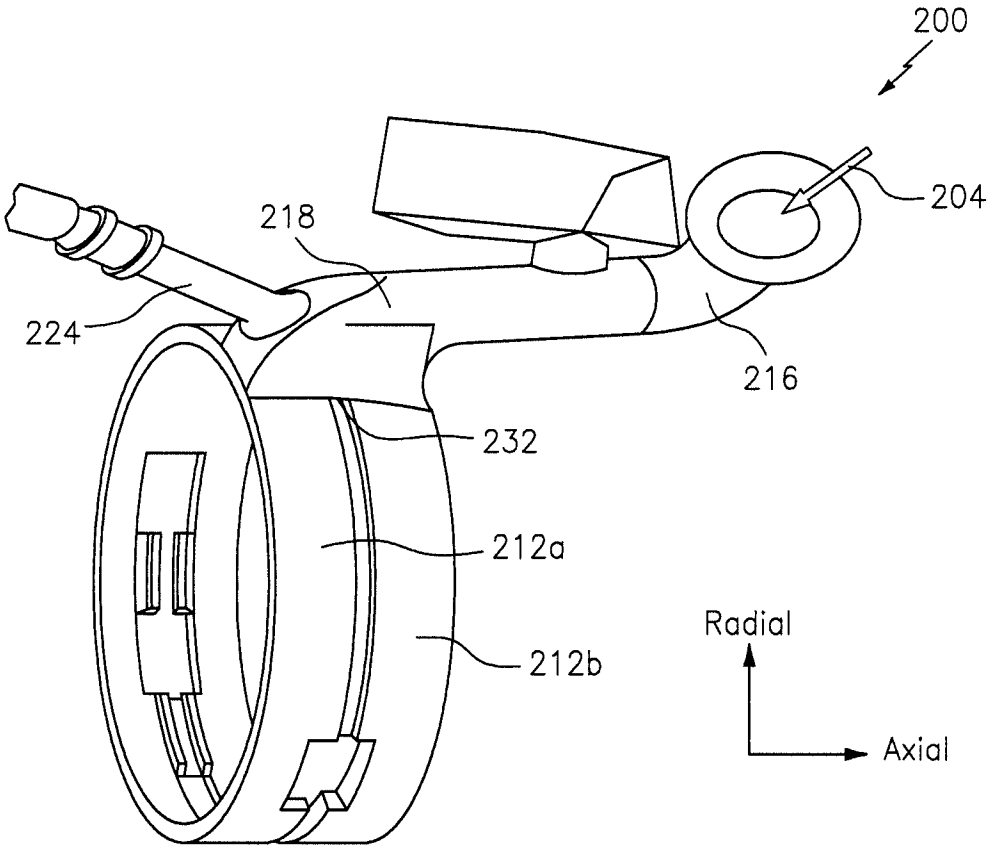
FIG. 2 (PRIOR ART)
FIG. 2 illustrates a prior art active clearance control (ACC) system.
Figure 5:
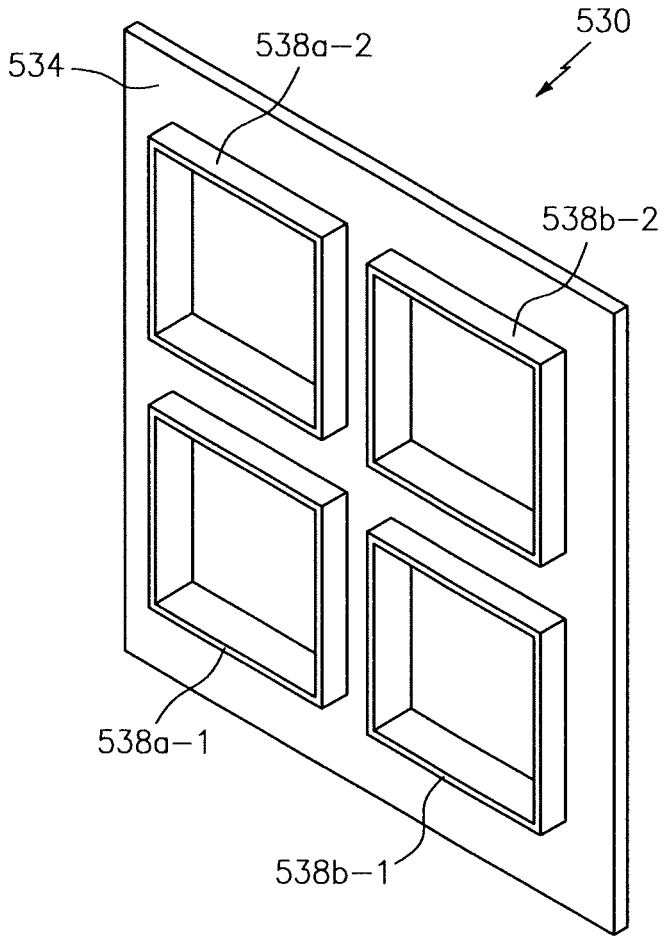
FIG. 5 illustrates an insert of an ACC system in accordance with aspects of this disclosure.

While some of the examples described herein related to an insert (e.g., insert 330) including two posts (e.g., posts 338*a* and 338*b*), in some embodiments an insert may include any number of posts. For example, FIG. 5 illustrates an embodiment of an insert 530 that includes a flange 534, a post 538*a*-1, a post 538*a*-2, a post 538*b*-1, and a post 538*b*-2. The posts 538*a*-1 and 538*a*-2 may be seated in respective receptacles formed in a first manifold and the posts 538*b*-1 and 538*b*-2 may be seated in respective receptacles formed in a second manifold. Referring to the geometry/orientation associated with FIGS. 2-4, the posts 538*a*-1 and 538*a*-2 may be substantially located in a first axial plane/station and the posts 538*b*-1 and 538*b*-2 may be substantially located in a second axial plane/station that is different from the first axial plane/station.

Technical effects and benefits of this disclosure include an insert that bridges a potential (axial) gap between two or more manifolds. The insert may be coupled to the manifolds and may be coupled to a collector of an ACC system. The insert may accommodate relative movement between at least two of a first of the manifolds, a second of the manifolds, and a collector over an operating range of an engine while ensuring that adequate sealing is provided (e.g., leakage at an interface between the collector and the manifolds may be less than a threshold).

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. An active clearance control system for an engine of an aircraft, comprising:

a collector that is configured to receive a cooling fluid;

at least two manifolds coupled to the collector, where a first of the manifolds is configured to receive at least a first portion of the cooling fluid from the collector and a second of the manifolds is configured to receive at least a second portion of the cooling fluid from the collector; and an insert coupled to the collector and the manifolds, wherein the insert is configured to seal an interface between the collector and the at least two manifolds over an operating range of the engine;

wherein the insert includes a first post that is seated in a first receptacle formed in the first manifold allowing the first portion of the cooling fluid to flow from the collector to the first manifold and a second post that is seated in a second receptacle formed in the second manifold allowing the second portion of the cooling fluid to flow from the collector to the second manifold;

wherein the insert includes a flange that is coupled to the first post and the second post and bridges a gap formed between the first manifold and the second manifold; and wherein the flange includes at least one of a foam material, rubber, ceramic fibers, or graphite.

2. The active clearance control system of claim 1, wherein the insert includes a third post that is seated in a third receptacle formed in the first manifold and a fourth post that is seated in a fourth receptacle formed in the second manifold.

3. The active clearance control system of claim 2, wherein the first post and the third post are substantially located in a first axial plane of the engine.

4. The active clearance control system of claim 3, wherein the second post and the fourth post are substantially located in a second axial plane of the engine, wherein the second axial plane is different from the first axial plane.

5. The active clearance control system of claim 1, wherein the first post has a square cross-section where the first post meets the first receptacle.

6. The active clearance control system of claim 1, wherein a radially-oriented height of the first post is larger than a threshold that is based on a maximum separation between the collector and the first manifold over the operating range of the engine.

7. The active clearance control system of claim 1, wherein the insert includes sheet metal.

8. The active clearance control system of claim 1, wherein the cooling fluid includes air received by the collector from a compressor section of the engine.

9. The active clearance control system of claim 8, further comprising:

an inlet pipe configured to convey the air from the compressor section to the collector.

10. An insert configured to be coupled to a collector of an active clearance control system of an engine of an aircraft, the insert comprising:

a flange;

a first post coupled to the flange and configured to be seated in a first receptacle formed in a first manifold where the first post allows a first portion of bleed air in a collector to flow from the collector to the first manifold;

a second post coupled to the flange and configured to be seated in a second receptacle formed in the first manifold where the second post allows a second portion of the bleed air in the collector to flow from the collector to the first manifold;

a third post coupled to the flange and configured to be seated in a third receptacle formed in a second manifold where the third post allows a third portion of the bleed air in the collector to flow from the collector to the second manifold; and a fourth post coupled to the flange and configured to be seated in a fourth receptacle formed in the second manifold where the fourth post allows a fourth portion of the bleed air in the collector to flow from the collector to the second manifold;

wherein the insert includes sheet metal and the flange includes a foam material.

* * * * *